US008843256B2

(12) United States Patent
Maurizio et al.

(10) Patent No.: US 8,843,256 B2
(45) Date of Patent: Sep. 23, 2014

(54) METHOD AND APPARATUS FOR DETERMINATION OF THE TRACK OCCUPANCY STATE OF A TRACK CIRCUIT ON A RAILWAY LINE VIA SEQUENTIAL DECODING

(75) Inventors: Morelli Maurizio, Genoa (IT); Daniele Trentini, Genoa (IT)

(73) Assignee: Sirti S.p.A., Milan (IT)

( * ) Notice: Subject to any disclaimer, the term of this patent is extended or adjusted under 35 U.S.C. 154(b) by 401 days.

(21) Appl. No.: 13/383,776

(22) PCT Filed: May 28, 2010

(86) PCT No.: PCT/EP2010/003284

§ 371 (c)(1),
(2), (4) Date: Jul. 30, 2012

(87) PCT Pub. No.: WO2011/006556

PCT Pub. Date: Jan. 20, 2011

(65) Prior Publication Data

US 2013/0015296 A1 Jan. 17, 2013

(30) Foreign Application Priority Data

Jul. 14, 2009 (IT) ..... TO2009A0525

(51) Int. Cl.
*B61L 1/18* (2006.01)

(52) U.S. Cl.
CPC ..... *B61L 1/188* (2013.01)
USPC ..... 701/19

(58) Field of Classification Search
CPC ..... B61L 1/18
USPC ..... 701/19
See application file for complete search history.

(56) References Cited

U.S. PATENT DOCUMENTS 4,320,881 A * 3/1982 Campbell ..... 246/34 B
4,582,279 A * 4/1986 Pontier ..... 246/34 B
2006/0155433 A1 7/2006 Oguma

FOREIGN PATENT DOCUMENTS

GB 2193588 A 2/1988

OTHER PUBLICATIONS

International Search Report Dated Sep. 13, 2010.

* cited by examiner

*Primary Examiner* — Helal A Algahaim
*Assistant Examiner* — Genna Mott
(74) *Attorney, Agent, or Firm* — Hedman & Costigan, P.C.; James V. Costigan; Kathleen A. Costigan

(57) ABSTRACT

An apparatus for determining the state of occupation of a track circuit on a railway line provided with a plurality of track circuits adjacent to one another, said circuit comprising a pair of rails (R) formed by parallel metal sectional elements between which it is possible to apply a voltage, each track circuit being separated from the adjacent stretch via electrically insulating joints (G). Said apparatus comprises a transmission block (2) capable of transmitting to the track circuit an a.c. voltage signal, associated to which is a predetermined sequence of at least three codewords that are different from one another.

9 Claims, 2 Drawing Sheets

1. TRANSMIT VOLTAGE SIGNAL ON A TRACK CIRCUIT

2. ASSOCIATE PREDETERMINED SEQUENCE OF THREE CODEWORDS TO SAID SIGNAL

3. DETECT A VOLTAGE VIA THE TRACK CIRCUIT

4. COMPARE SAID DETECTED VOLTAGE SIGNAL WITH CODEWORDS TO OBTAIN AN ENERGY VALUE FOR EACH FREQUENCY COMPONENT OF THE CODEWORD

5. VERIFY THE PRESENCE OF THE SAME FREQUENCY OF THE CODEWORD WITH THE SAME ENERGY VALUE

6. DETECT A CODEWORD AND ITS FREQUENCY CONTENT PRIOR TO SUBTRACTING THE ENERGY VALUE BY VECTOR SUBTRACTION

OPTIONALLY REPEAT STEPS 4-6

OPTIONALLY COMPARING THE RESULTS OF STEP 6 WITH A THRESHOLD VALUE TO ASSIGN AN OCCUPIED STATUS TO THE TRACK CIRCUIT IF AT LEAST ONE OF THE VALUES IS LOWER THAN THE THRESHOLD VALUE OR IF THE RESULTS OF STEP 6 ARE NOT LOWER THAN THE THRESHOLD VALUE THE OCCUPATION OF THE TRACK CIRCUIT IS IN THE FREE STATE.

7. COMPARE THE VALUE OF THE CODEWORD WITH THE PREDETERMINED VALUE OF THE CODEWORD

8. ISSUE A SIGNAL INDICATING THE OCCUPATOIN OF THE TRACK CIRCUITON THE BASIS OF THE COMPARISON OF THE VALUE OF THE CODEWORD WITH THE PREDETERMINED VALUE OF THE CODEWORD

Fig. 2

METHOD AND APPARATUS FOR DETERMINATION OF THE TRACK OCCUPANCY STATE OF A TRACK CIRCUIT ON A RAILWAY LINE VIA SEQUENTIAL DECODING

The present invention regards a method and an apparatus for determining the state of occupation of a track circuit on a railway line via sequential decoding. In particular, the present invention regards detection of the presence of a train, or other vehicle that can move on tracks, in a track circuit of a railway line.

According to railway jargon, a track circuit is a section of railway track of a variable length (from a few tens of meters to several kilometers) electrically insulated from the adjacent sections of railway track and with a low voltage applied on the set of the two rails. The application of the voltage on the electrified rails occurs at one end of the section of track, and a voltage detector is applied in parallel to said point of supply. When there are no vehicles on that section of track, the detector extracts a voltage other than zero since the electrified rails are not short-circuited by the presence of the axles of the train, whereas in the case where any railway vehicle reaches that section of track, with its own axles it short-circuits the rails to one another and triggers a circulation of current that is detected by the detector or sensor through the absence of voltage across the two rails.

This technology hence enables continuous production of information on the presence in a section of track of (stationary or travelling) vehicles, and as such is used for automating control of a railway line.

The information that is received by the track circuit is reliable if the latter is absolutely electrically insulated from ground, or from an adjacent track circuit. Furthermore, the measurement environment is extremely noisy (it is sufficient to consider the noise of traction of the electric locomotives), and the measurement method must be practically immune to noise signals even of high intensity. In addition, in the event of absence of a train on the circuit, the current supplied by the generator is not zero as a result of the resistance of dispersion between the insulating joints, and as a result of the resistance of dispersion between the tracks (which depends, for example, upon the railway ballast).

One proposed solution envisages sending on the circuit an a.c. voltage signal, associated to which is a unique codeword that consists in arranging a pre-set number of positive and negative half-waves of said a.c. voltage according to a predetermined sequence.

Said signal is extracted by a reception block and is subsequently compared with said unique and predetermined codeword for verifying whether the information is correct or else whether the signal received is in fact noise.

Even if efficient, said system does not contemplate the case where the noise is "in band" noise, i.e., noise that has spectral contents in the frequencies where the unique codewords present in the transmitted sequence have spectral contents.

The purpose of the present invention is to overcome the aforementioned drawbacks and find a reliable method for detecting with certainty the signal identifying the state of occupation of a track circuit.

The present invention proposes a method and an apparatus in which, in a track circuit forming part of a railway line, the signal at low a.c. voltage is modulated in phase by a predetermined digital sequence of at least three mutually orthogonal unique digital codewords, thus carrying out a sequential coding.

Said coding consists in associating to the information a sequence of codes that identifies it uniquely with respect to all the others and that enables a receiver to extract the information coming from the relevant track circuit and not the information coming from an adjacent circuit. An aspect of the present invention regards an apparatus for verification of the occupation of a track circuit on a railway line having the characteristics of claim 1.

A further aspect of the present invention regards a method for verification of the occupation of a track circuit on a railway line presenting the characteristics of claim 7.

BRIEF DESCRIPTION OF THE SEVERAL VIEWS OF THE DRAWINGS

FIG. 2 is a flow chart that shows the sequence of the steps of the invention.

Figure 1:
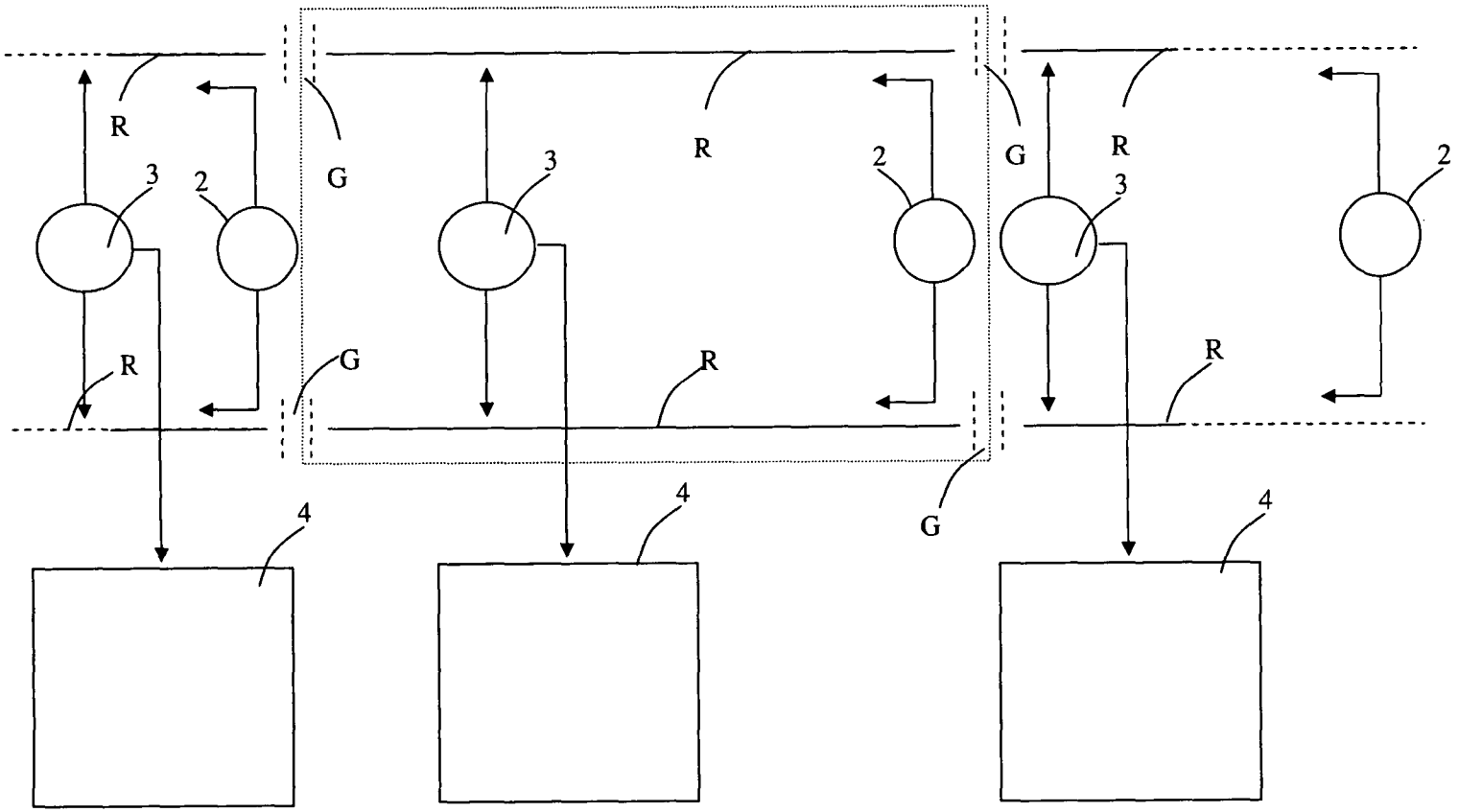
FIG. 1 is a block diagram of the apparatus of the invention.

The characteristics and advantages of the method and apparatus according to the present invention will emerge more clearly from the following description, which is provided purely by way of non-limiting example, of an embodiment thereof, with reference to the attached FIG. 1, which represents a block diagram of the apparatus according to the present invention.

With reference to the aforesaid FIG. 1, the apparatus according to the present invention is applied on a track circuit, which basically comprises a pair of rails R formed by parallel metal sectional elements that are normally T-shaped, mounted transverse to a load-bearing structure formed by sleepers made of wood, steel, or cement. Each track circuit is separated from the adjacent stretch via electrically insulating joints G. A plurality of adjacent track circuits insulated from one other are present on a railway line, FIG. 2 is a diagram of the steps that are used in the method of the invention. The steps of FIG. 2 that are numbered are the required steps and optional steps are the unnumbered steps.

The apparatus according to the present invention for each track circuit comprises a transmission block 2 capable of transmitting to the circuit a predetermined sequence of codewords that are different from one other, for example mutually orthogonal, which modulate in phase an a.c. voltage signal.

For the purposes of the present invention, by "orthogonal" it is meant that the scalar product between two orthogonal codewords is zero.

Preferably, each codeword is obtained by arranging a preset number of positive and negative half-waves of said a.c. voltage according to a predetermined series.

In particular, a so-called spread word S is generated, comprising, for example, 16 bits, in which each bit is equivalent to a cycle of the sinusoid at the considered frequency, where the bit with value "1" envisages the cycle of sinusoid at the considered frequency with zero phase, whereas the bit with value "0" envisages the cycle of sinusoid with phase 180°.

Said voltage signal, on which the codeword is superimposed or to which the codeword is associated, is the traditional voltage signal at 50 Hz, at 83.3 Hz, or at another frequency that is used for detecting the passage of the train on that track circuit.

Exploiting said property, the apparatus of the present invention moreover comprises a block 3 for extraction or detection of a voltage signal that varies its value between a maximum value, in the event of absence of a train, and a minimum value, when the presence of the train closes the electrical track circuit, and a block 4 for processing said signal.

The signal detected is sent to the processing block, which comprises a microprocessor and at least one analog-to-digital converter for converting said extracted signal.

Processing block 4 is adapted to compare said predetermined sequence of at least three predetermined codewords with the extracted signal.

Said extracted or detected signal, under normal conditions, should contain the correct predetermined sequence of unique codewords. In the presence of a noise of a stationary type, it is possible that, in a time interval of the sequence in which it is expected to receive a predetermined codeword, two or more thereof are received, one of which is correct and the others are, instead, the result of said noise.

Via said processing block, the present invention is able to recognize the noise, reconstruct the correct predetermined time sequence, and determine with certainty whether the track is really occupied, generating emission of an occupation signal, which has two states, "occupied" and "free", which reveals the state of occupation of the track itself.

According to a preferred embodiment of the invention, the transmitter transmits repeatedly for predetermined time intervals a predetermined sequence of at least three different codewords, for example a first word A, a second word B, and a third word C (ABC-ABC-ABC . . . ).

Advantageously the sequence can comprise a first pair, a second pair, and a third pair of words that are the same so as to be able to carry out twice the detection in one and the same time interval for each word (e.g., AABBCC-AABBCC . . . ). In this way, the reliability of the measurement is increased.

The reception block is initially synchronized with the transmission block. In each predetermined time interval, it detects the transmitted signal. The processing block, which knows what should be the correct sequence (ABC), compares the signal detected in a first time interval with the three codewords of the sequence. If from the comparison there emerges the presence of a single codeword (e.g., A), this means substantially that there is no noise, and detection of the signal is carried out at the next second time interval. If, instead, the presence of a first codeword and a second codeword that are different from one another is detected (e.g., A+C), the magnitude and phase of the frequency components of both of them is measured. In this case, one of the two words could in actual fact be stationary noise. In the second time interval, ideally only the word B should be received; the comparison between the signal detected and the three codewords of the sequence is repeated. If said stationary noise is present in this second time interval, presence of two codewords (e.g., B+C) is verified, one of which is one of those detected in the preceding time interval: in the example, the word C. Also in this time interval, the magnitudes or the energy values associated to the frequency components of the words are measured. If the value of magnitude of said frequency component present in the first time interval coincides with that of the second time interval, then it may be considered the value of the stationary noise. Passing to the third time interval, only the third codeword is expected to be received, namely C in the example mentioned, it being possible for said value to be greater than or equal to the value of the stationary noise identified in the two preceding time intervals.

If the vector subtraction between the calculated vector value of the stationary noise (thanks to the values detected in the preceding time intervals) and the vector of the codeword detected in the third time interval is positive and corresponds to the predetermined nominal value of the third word, then said result is reliable to be able to establish whether the track circuit under examination is occupied or not, irrespective of the noise injected on the spectral lines of the code (in band).

The method of comparison and subtraction is repeated for all the codewords (A, B, C).

The energy values $K_A$, $K_B$, and $K_C$, associated to the cross-correlations with the three codewords of the sequence (A, B, C), which are "purged" of the contributions of the stationary in-band disturbance, are compared with a threshold value k; the measurement method considers the track circuit as being "occupied" if at least one of the values is lower than the threshold; otherwise, it judges the track as being "free".

The comparison between the words is made by carrying out the scalar product between said signal and the codewords of the sequence assigned to that specific track circuit.

The invention claimed is:

1. An apparatus for determining the state of occupation of a track circuit on a railway line provided with a plurality of track circuits adjacent to one another, said circuit comprising a pair of rails (R) formed by parallel metal sectional elements between which it is possible to apply a voltage, each track circuit being separated from the adjacent section by electrically insulating joints (G), characterized in that it comprises: a transmission block (2), configured to transmit to the track circuit an a.c. voltage signal, associated to which is a predetermined sequence of at least three codewords different from one another, each codeword being sent in the sequence in pre-set time intervals;

at least one detection block (3) for detecting a voltage signal from the track circuit to obtain a detected voltage signal; and at least one processing block (4) configured to compare said predetermined sequence of at least three predetermined unique codewords with the detected voltage signal, said apparatus also being configured to a) in comparing said detected voltage signal with said predetermined unique codewords, obtain an energy value for each frequency component of said codeword;

b) verify the presence of a same frequency component of the codeword with a same energy value in two successive time intervals; and c) in the time interval subsequent to the two in which the presence of the same frequency component of the codeword with the same energy value has been verified, detecting a codeword and its frequency content, and subtracting said same energy value from it by vector subtraction.

2. Apparatus according to claim 1, wherein said processing unit computes the scalar product between said voltage signal and each of the codewords of the predetermined sequence assigned to the track circuit to obtain an energy value for each codeword.

3. Apparatus according to claim 1, wherein the processing block comprises a microprocessor and at least one analog-to-digital converter for converting said detected signal.

4. Apparatus according to claim 1, wherein each codeword of the sequence is orthogonal to the other codewords of the same sequence.

5. Apparatus according to claim 1, wherein the voltage is an a.c. sinusoid voltage and each codeword is formed by arranging a pre-set number of positive and negative half-waves of said a.c. sinusoid voltage according to a predetermined series.

6. Apparatus according to claim 5, wherein each codeword comprises 16 bits, wherein each bit is equivalent to a cycle of the sinusoid voltage at the frequency considered, where the bit with value "1" envisages the cycle of sinusoid voltage at the frequency considered with zero phase, whereas the bit with value "0" envisages the cycle of sinusoid voltage with phase 180°.

7. A method for verifying the occupation of a track circuit on a railway line provided with a plurality of track circuits adjacent to one another, said circuit comprising a pair of rails (R) formed by parallel metal sectional elements (B), between which it is possible to apply a voltage, characterized in that it comprises the following steps:

a) transmitting a voltage signal on a track circuit;

b) associating a predetermined sequence of at least three codewords different from one another to said signal, each codeword being sent in sequence in pre-set time intervals;

c) detecting a voltage signal via the circuit;

d) in each of said predetermined time intervals, comparing said voltage signal detected with all the codewords of the sequence to obtain an energy value for each frequency component of said codeword;

e) verifying the presence of the same frequency component of the codeword with the same energy value in two successive time intervals;

f) in the time interval subsequent to the two in which the presence of the same frequency component of the codeword with the same energy value has been verified, detecting a codeword and its frequency content, and subtracting said same energy value from it by vector subtraction;

g) comparing the value of the codeword obtained in point f) with the predetermined nominal value for that codeword;

h) issuing on the basis of said processing a signal regarding occupation of the track circuit.

8. Method according to claim 7, wherein the procedure of comparison and subtraction of the preceding steps d), e), f) is repeated for all the codewords of the sequence.

9. Method according to claim 8, wherein the energy values, associated to the cross-correlations with the three codewords of the sequence, which are the results of the subtractions, are compared with a threshold value and the signal indicating occupation of the track circuit is brought to the "occupied" state if at least one of the values is lower than the threshold; otherwise, it is brought to the "free" state.

* * * * *